US006045838A

United States Patent [19]

Davis et al.

[11] Patent Number: 6,045,838

[45] Date of Patent: Apr. 4, 2000

[54] GRAPE HANDLING AND STORAGE BAG

[76] Inventors: Harold L. Davis, P.O. Box 695, Coarsegold, Calif. 93614; F. Gordon Mitchell, 747 Elmwood Dr., Davis, Calif. 95616-3516; Carlos H. Crisosto, 248 Redwood Dr. Cir., Reedley, Calif. 93654; Larry Faulkner; Rene Contreras, both of 1740 S. Sacramento Ave., Ontario, Calif. 91761

[21] Appl. No.: 09/131,630

[22] Filed: Aug. 10, 1998

Related U.S. Application Data

[60] Provisional application No. 60/055,580, Aug. 12, 1997.

[51] Int. Cl.[7] ..... B65B 85/00; B65B 33/01

[52] U.S. Cl. ..... 426/106; 426/118; 426/407; 426/415; 383/103

[58] Field of Search ..... 426/106, 407, 426/415, 118, 419; 383/103

[56] References Cited

U.S. PATENT DOCUMENTS

| | | | |
|---|---|---|---|
| H9 | 1/1986 | Ashmore | 206/497 |
| 3,399,822 | 9/1968 | Kugler | 426/106 |
| 3,797,732 | 3/1974 | Melin et al. . | |
| 4,629,064 | 12/1986 | Barner . | |
| 4,743,123 | 5/1988 | Legters et al. . | |
| 4,886,372 | 12/1989 | Greengrass et al. | 383/100 |
| 4,954,033 | 9/1990 | Sanders . | |
| 5,130,152 | 7/1992 | Alameda | 426/106 |
| 5,171,593 | 12/1992 | Doyle | 426/106 |
| 5,354,569 | 10/1994 | Brown et al. . | |
| 5,375,929 | 12/1994 | Bergmoser | 383/38 |
| 5,402,906 | 4/1995 | Brown et al. | 220/403 |
| 5,427,808 | 6/1995 | Adams | 426/419 |
| 5,458,899 | 10/1995 | Floyd et al. | 426/404 |
| 5,492,705 | 2/1996 | Porchia et al. | 426/106 |
| 5,609,293 | 3/1997 | Wu et al. . | |
| 5,698,249 | 12/1997 | Hayashi et al. | 426/106 |
| 5,738,890 | 4/1998 | Cadiente et al. | 426/106 |
| 5,919,504 | 7/1999 | Muise et al. | 426/106 |

FOREIGN PATENT DOCUMENTS 0829484 5/1981 U.S.S.R. .

*Primary Examiner*—N. Bhat
*Attorney, Agent, or Firm*—Limbach & Limbach, L.L.P.

[57] ABSTRACT

An improved grape storage and handling bag is disclosed. The bag has increased size and reduced venting. The bag of the invention has holes on one or both side walls of the bag to provide a percentage perforation ranging from 0.4 to 1.4%. The bag reduces water loss while still permitting $SO_2$ ventilation. Grapes stored in the bags of this invention show reduced levels of water loss, stem browning, berry shatter, and decay. The grapes may be stacked in one or two layers. The bagged grapes are contained within a container and stacked in one or two layers within the containers.

24 Claims, 3 Drawing Sheets

GRAPE HANDLING AND STORAGE BAG

RELATED APPLICATION

This application claims the benefit under 35 U.S.C. §119 (e) of United States Provisional Application No. 60/055,580, filed Aug. 12, 1997.

FIELD OF THE INVENTION

This invention relates to a fruit handling and storage bag. In particular, this invention relates to a vented, plastic handling and storage bag for grapes that maximizes $SO_2$ exchange while minimizing water loss and shattering.

BACKGROUND OF THE INVENTION

Table grapes are a popular food item. Grape growers, packers and distributors are continually attempting to minimize the cost of grape distribution while improving the quality of grapes available for the consumer.

One improvement in grape harvesting and storage procedures was to treat grapes with $SO_2$ after harvest. This post-harvest treatment serves to minimize microbial (especially fungal) growth and to seal the grapes to preserve freshness.

Another improvement was to place grapes in plastic storage bags soon after harvest to minimize water loss. Cumulative water loss during post-harvest handling results in weight loss, stem browning, berry shatter, decay and even shriveling of grape berries. While storage of grapes in plastic bags reduced grape water loss, these bags did not permit $SO_2$ penetration during post-harvest $SO_2$ treatment which resulted in increased microbial contamination problems.

One solution to this problem was to store grapes in plastic bags containing multiple slits and openings at the side walls of the bags. These bags were an improvement over bags without slits and openings because $SO_2$ more easily penetrated the bags for post-harvest $SO_2$ treatment. However, grapes stored in these slitted bags lost unacceptable amounts of water as a result of increased air exposure. In addition, the grapes stored in the slitted bags had a tendency to shatter (fall off the stem) which is generally unacceptable to the consumer.

Thus, there is a need for an improved grape storage and handling bag that permits $SO_2$ penetration for post-harvest $SO_2$ treatment while minimizing grape water loss and shattering.

SUMMARY OF THE INVENTION

This invention is directed to an improved grape handling and storage bag. In particular, this invention is directed to a plastic bag for grape storage and handling having increased size and reduced ventilation compared to prior art grape storage bags. The bag of the present invention is designed to maximize $SO_2$ penetration while minimizing grape water loss. Once they are filled with grapes, the bags of present invention are stored and shipped in cartons containing 1 or 2 layers of grape bags.

In a first embodiment, the plastic bag of the invention includes a top opening, side walls, a bottom and side seams. The bag is generally made from plastic film and includes holes distributed in one or both side walls of the bag to provide a percentage perforation ranging from 0.4 to 1.4%. The preferred range for the percentage perforation is 1.0–1.4% when the bags are filled with grapes and stacked in two layers during shipment and storage. The preferred perforation range is 0.4 to 1.4% when the bags are filled with grapes and are stacked in single layers during shipment and storage. The holes preferably have a diameter of about ⅛ inch to about ¼ inch (3125 to 6250 microns). The plastic film has a thickness ranging from 0.00100 to 0.00200 mil. in thickness, preferably 0.00150 to 0.00175 mil. in thickness.

In this first embodiment, the bottom of the bag preferably has a length from about 5½ to about 8 inches and the top opening preferably has a length of 13 to 14 inches. The bag preferably will include three spaced apart apertures positioned on the side walls about 1½ inches below the top opening.

In another embodiment, the plastic grape storage bag of the invention may be adapted to be mounted on a grape packing platform. In this embodiment, the bag includes a front wall, a rear wall, an open end and a closed end. In this format, the front and rear walls have a plurality of holes distributed in one or both walls to provide a percentage perforation ranging from 0.4 to 1.4%.

In this second format, the closed end of the bag generally has a length from about 5½ to about 8 inches and each of the holes has a diameter of ⅛ to ¼ inch (3125 to 6250 microns).

In this second format, the bag further includes three spaced-apart apertures for accommodation of the posts of a grape packing platform.

BRIEF DESCRIPTION OF THE DRAWINGS

This invention will be better understood by reference to the figures, in which.

DETAILED DESCRIPTION OF THE INVENTION

Figure 1:
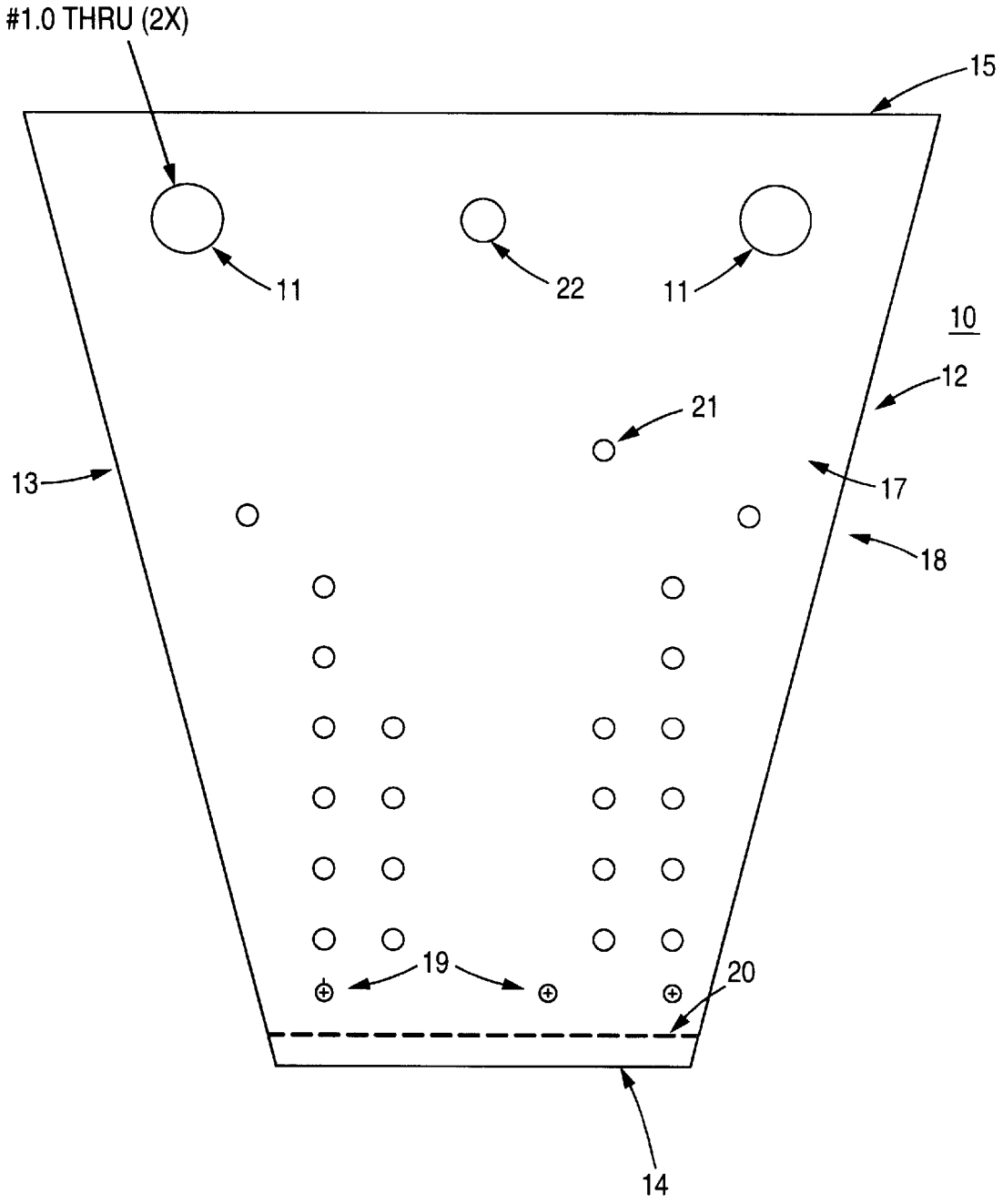
FIG. 1 illustrates a grape handling and storage bag with 1.4% perforation and a 13-inch opening.

This invention is directed to an improved grape storage and handling bag. The bag of this invention provides for rapid packaging of grapes in the field, ease of treatment with $SO_2$ during storage and minimal grape water loss during storage. Once filled with grapes, the grape storage bags of this invention may be stored and shipped in cartons containing one or two layers of grape bags.

In its broadest scope, the present invention includes a flexible, thermoplastic film material for packaging grapes comprising a web of thermoplastic material having a selected number of holes to give a defined percentage perforation. In producing the holes in a film web, small amounts of film material are removed from the film web to leave multiple holes sufficient to provide maximum $SO_2$ penetration while minimizing water loss from the grapes.

The term "plastic storage bags" as used herein refers to plastic bags produced from various known plastics. Such plastics include polyolefins such as polypropylene and/or mixtures of polyethylenes. Such plastics can be colored or tinted with pigment. Preferred colors include green, black and red.

The term "grapes" as used herein includes various table grapes including green, black and red grapes, seedless and non-seedless grapes. The bags of this invention are useful for storing for all varieties of seedless and seeded grapes now in production and are anticipated to be useful for storing new grape varieties as they are later developed. Varieties useful in the invention include 'Ruby Seedless', Flame Seedless', 'Crimson Seedless', 'Red Globe' and 'Thompson Seedless' and other new grape varieties as they are developed.

The term "sulfur dioxide ($SO_2$) treatment" as used herein refers to a procedure by which grapes are treated with 100 to 150 ppm-hours $SO_2$. Grapes are initially gassed upon receipt from the field and then, generally, weekly thereafter. Treatment with $SO_2$ serves to minimize microbial growth and to seal the grapes to preserve freshness.

The term "percentage perforation" as used herein refers to the percent openings in one or both side walls of a plastic bag. The percentage perforation does not include the top opening or any apertures designed for mounting the plastic bag on a grape packing platform but does include all other openings on side wall(s) of the bag including those openings designed to release accumulated water. A bag with 99% perforation contains a small amount of plastic side wall (1%) and contains 99% openings in the side wall. A bag with 1% perforation includes 99% plastic side walls and contains 1% openings in the side walls. A bag without openings in the side walls but containing apertures for supporting the bag on a grape packing platform would have 0% perforation. Prior art plastic grape handling and storage bags have approximately 30–40% openings in the side walls resulting in a percentage perforation of 30–40%.

The terms "holes" are used herein to refer to openings in one or both side walls of the plastic bag of the invention. These holes range in size from ⅛ to ¼ inch or 3125 microns to 6250 microns. The shape of the holes is not critical, as long as the holes permit $SO_2$ penetration and reduce water loss. Typically, the holes are circular or elliptical in shape. In general, the holes can vary in size, but preferably most of the holes used in the bag are substantially the same size.

The term "apertures" as defined herein refers to openings in the side walls of the bags designed to adapt the plastic bag for mounting on a grape packing platform. As discussed above, apertures are not included in the calculation of the percentage perforation.

Bag Manufacture

The bags of this invention are manufactured on an Automatic Bag Machine. A preferred Automatic Bag Machine for use in this invention is a penwall design with a 3-belt system. The general method of making the plastic bags of the invention is shown in U.S. Pat. No. 4,954,033 which is hereby incorporated by reference. The bags of this invention consist of low-density polyethylene film extruded from resin. Such resin is available from, for example, Eastman Chemical Company and includes "Tenite" Polyethylene E 6838–923F. Eastman's product identification number is PLS E6838–923F.

FIG. 1 illustrates a 13 inch grape handling and storage bag. Plastic bag 10 includes a top opening 15, side seams 12 and 13, a bottom 14 and side walls 17 and 18. The bag illustrated in FIG. 1 has holes in both side walls. In the bags of this invention, the holes can be on one or both side walls.

In the manufacture of the bag in FIG. 1, the bag is sealed to form side seams 12 and 13 and a bottom seal 20 approximately 0.375" from the bottom edge of the film 14. The side walls 12 and 13 have a thickness of approximately 0.00125 mil. The width of the top of the bag is 13". The width of the bottom 14 of the bag is 6.5". The bag has a usable depth of approximately 13.125".

The bag illustrated in FIG. 1 has twenty two holes 21 of 0.312" diameter and three holes 19 of 0.250" diameter through both side walls of the bag to provide a percentage perforation of 1.4%. The positioning of the 0.312" holes is not critical so long as they are approximately evenly distributed across the surface of the bag. The 0.250" diameter holes are positioned near the bottom of the bag to serve as drains for water should there be any moisture condensation in the bag. These drainage holes are included in the percentage perforation calculations.

Figure 2:
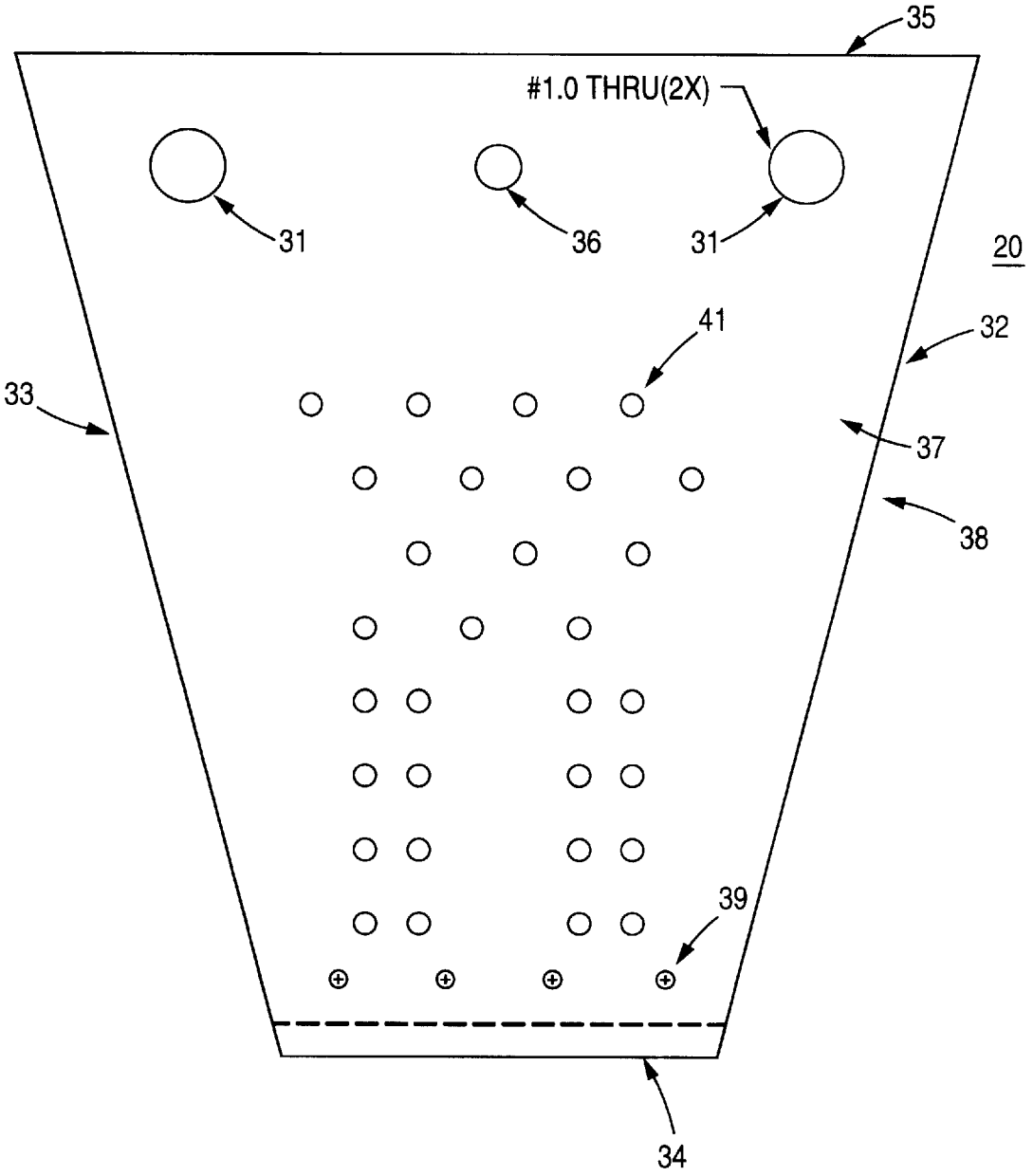
FIG. 2 illustrates a grape handling and storage bag with 1.4% perforation and a 14-inch opening.

In addition to the holes in the bag, there are three apertures in the side walls of the bag illustrated in FIG. 1. Two of the apertures 11 are 1" diameter apertures are positioned at the top of the bag, one 4.26" to the left of center an one 4.26" to the right of center. The center of each is 1.5" from the top edge of the bag 15. There is one aperture of 0.625" diameter on the centerline 22. The center of this hole is also 1.5" from the top edge of the bag 15. The positioning of the apertures is not critical but should be such to provide adequate support for the bag on a grape packing platform FIG. 2 illustrates a 14 inch grape handling and storage bag. Plastic bag 30 includes a top opening 35, side seams 32 and 33, a bottom 34 and side walls 37 and 38.

In the manufacture of the bag in FIG. 2, the bag is sealed on the left 32 and right 33 edges with a bottom seal approximately 0.375" from the bottom edge of the film 34. The thickness for both the front and back of the bag ranges from 0.00100 mil. to 0.00200 mil, preferably 0.00125 mil. The width of the top for the front side wall 32 and back side wall 33 is 14". The width of the bottom 34 for the front and back of the bag is 8.5". The web width of the bag is 13.5" with a usable depth of approximately 13.125".

The bag illustrated in FIG. 2 has thirty holes (41) 0.312" diameter and four holes (39) 0.250" diameter through both side walls of the bag to provide a percentage perforation of 1.4%. The positioning of the 0.312" holes is not critical so long as they are evenly distributed across the surface of the bag. The 0.250" diameter holes are positioned near the bottom of the bag to serve as drains for water should there be any moisture condensation in the bag. These drainage holes are included in the percentage perforation calculations.

In addition to the holes in the bag, there are two 1" diameter apertures 31 at the top of the bag, one 4.26" to the left of center an one 4.26" to the right of center. The center of each is 1.5" from the top edge of the bag. There is one hole 36 of 0.625" diameter on the centerline. The center of this hole is also 1.5" from the top edge 35.

Grape Packing

Grapes are generally packaged directly in the field soon after harvest. The grape storage bags of this invention are positioned on grape packing platforms by positioning the support posts of the storage platform through apertures in the plastic bags. Once positioned on the grape packing platform, harvested grapes are placed directly into the grape plastic storage bags.

Once they are filled with grapes, the bags are then transferred to grape storage containers. For two-layer packing of grape bags, plastic bags with a percentage perforation of 1.0 to 1.4% are utilized. For one-layer packing of grape bags, plastic bags with a percentage perforation of 0.4 to 1.4% are utilized. At percentage perforations higher than 1.4% the grapes had unacceptable levels of water loss for both one and two layer packaging. At percentage perforations less than 1% in two layer packaging, the bags provided inadequate $SO_2$ penetration. In one layer packaging the bags had inadequate $SO_2$ penetration when the percentage perforations was reduced to less than 0.4%.

The invention is further demonstrated by the following illustrative examples.

EXAMPLE 1

Water Loss in Grapes

Figure 3:
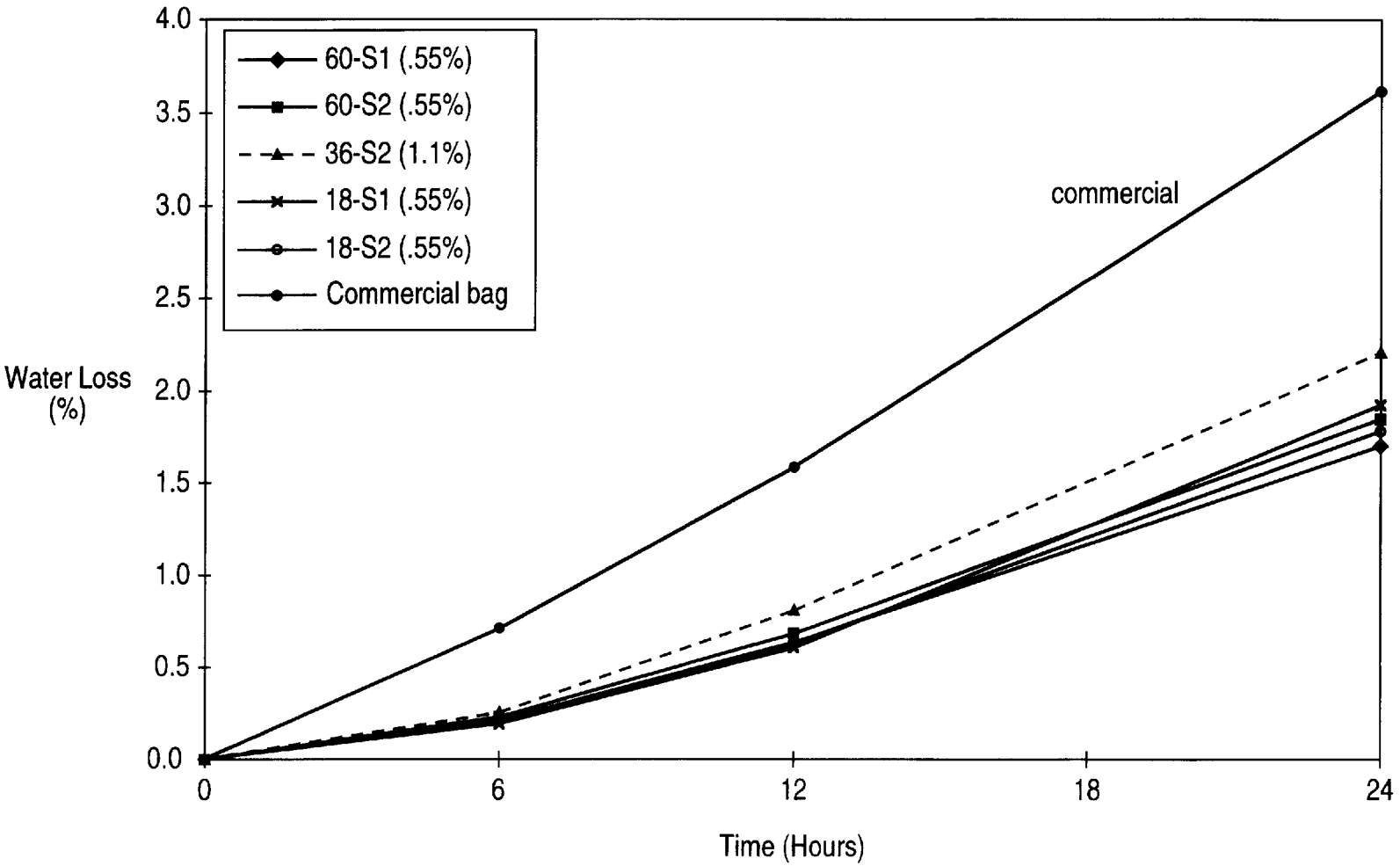
FIG. 3 illustrates the influence of cluster bag designs on Ruby seedless grape water loss.

The influence of cluster bag design on Ruby seedless grape water loss is shown in FIG. 3. Grapes were harvested and placed in plastic bags having 30 to 40% perforation (the commercial bag) or plastic bags having 0.55% perforation. The commercially available bag having a percentage perforation of approximately 30 to 40% shows significantly higher levels of water loss than those bags with 0.55% perforation.

EXAMPLE 2

Comparative testing

Cumulative water loss during post harvest handling results in weight loss, stem browning, berry shatter and even shrinking of berries. Thus, one simple and direct approach to reduce table grape stem browning is to reduce water loss during post harvest handling.

Ruby Seedless grapes were packed in the commercial cluster bag (with 30 to 40% perforation) or the restricted cluster bag of this invention (with 1.4% perforation) in foam boxes. Five boxes (10 kilograms) were field-packed for each treatment/evaluation date and stored at 32° F. at 90% relative humidity. Forced air cooling and initial fumigation were done at the same time. $SO_2$ penetration was measured initially and weekly during the storage period. Grapes were removed after 3, 6, and 9 weeks of cold storage for evaluation. Fruit were inoculated with a Botrytis solution before cold storage (32° F./90% RH). Decay, stem condition (stem browning and dryness), $SO_2$ phytotoxicity, shattering incidence, and buyer opinion grade were measured on each evaluation date.

After 3 weeks, the use of the restricted cluster bag with 1.4% perforation reduced stem browning and increased the buyer opinion grade without affecting decay and phytotoxicity as compared to grapes stored in bags with 30 to 40% perforation (Table 1). Grapes packed in the bags with 1.4% perforation were categorized as "good" according to the buyer opinion grade.

After 6 weeks, grapes from the bags with 1.4% perforation showed better stem condition (browning and dryness) than grapes from the control (30 to 40% perforation). In both treatments, decay incidence was low (Table 2). By the 9 week evaluation date, stem dryness was classified as "severe" in the control (commercial cluster bag, 30–40% perforation) fruit, but "moderate" in the restricted cluster bag (1.4% perforation). According to the buyer opinion grade, grapes packed in the restricted cluster bag were categorized as "fair" while grapes packed in the commercial cluster bag were categorized as "poor" (Table 3).

During this trial, fruit packed in the top of the box had a higher shattering incidence than the fruit packed in the bottom of the box (Tables 1, 2, & 3). However, fruit packed with the restricted bag (1.4% perforation) had less shattering than fruit packed with the commercial bag (30–40% perforation): 16.7% for bags with 1.4% perforation as compared to 21.3% for bags with 30–40% perforation.

During this storage period, the restricted and commercial cluster bags did not show any excessive condensation. $SO_2$ penetration was adequate in the two types of cluster bags during the initial treatment and weekly fumigations thereafter. Preliminary cooling tests suggest that there is not a significant reduction in cooling time. By the last date of evaluation, a higher level of phytotoxicity ($SO_2$ damage) was detected in grapes packed with the commercial cluster bag (Table 3) than in grapes packed with the restricted cluster bag.

The results indicate that the restricted cluster bag (1.4%) was more effective in reducing water loss and maintaining stem freshness without interfering with $SO_2$-penetration than the commercial cluster bag (30–40% perforation).

TABLE 1

Quality of "Ruby Seedless" table grapes packaged in commercial or restricted cluster bags then stored at 0° C.

| Treatment | Decay (% wt.) | Stem Condition (score 1–4)[x] Browning | Stem Condition (score 1–4)[x] Dryness | Phytotoxity (% wt.) | Shatter (% wt.) | Grade[y] (1–4) |
|---|---|---|---|---|---|---|
| Bag Type | | | | | | |
| Restricted[b] | 0.01 | 1.8 | 2.3 | 13.0 | 14.0 | 3.1 |
| Commercial[a] | 0.05 | 2.0 | 2.6 | 15.8 | 18.6 | 2.5 |
| P-value | NS | NS | 0.014 | 0.098 | 0.016 | 0.0001 |
| $LSD_{0.05}$ | NS | NS | 0.3 | 2.3 | 3.7 | 0.3 |
| Bag Position | | | | | | |
| Top | 0.01 | 2.0 | 2.5 | 15.8 | 20.7 | 2.7 |
| Bottom | 0.05 | 1.9 | 2.4 | 13.1 | 11.8 | 2.8 |
| P-value | NS | NS | NS | 0.103 | 0.0001 | NS |
| $LSD_{0.05}$ | 0.06 | NS | NS | 3.3 | 3.7 | NS |
| Bag Type x Bag Position | | | | | | |
| Restricted x Top | 0.00 | 2.0 | 2.5 | 13.2 | 19.1 | 3.0 |
| Restricted x Bottom | 0.02 | 1.6 | 2.0 | 12.8 | 11.9 | 3.2 |
| Commercial x Top | 0.03 | 1.9 | 2.5 | 18.4 | 25.4 | 2.4 |
| Commercial x Bottom | 0.08 | 2.2 | 2.3 | 13.3 | 11.7 | 2.5 |
| P-value | NS | 0.066 | 0.0087 | NS | 0.012 | NS |

[a]Commercial bag = 30 to 40% perforation
[b]Restricted bag = 1.4% perforation
[x]Stem score: 1 = healthy, 2 = slight, 3 = moderate, 4 = severe
[y]Grade: 1 = poor, 2 = fair, 3 = good, 4 = excellent

TABLE 2

Quality of "Ruby Seedless" table grapes packaged in commercial or restricted cluster bags then stored at 0° C.

| Treatment | Decay (% wt.) | Stem Condition (score 1–4)[x] Browning | Dryness | Phytotoxity (% wt.) | Shatter (% wt.) | Grade[y] (1–4) | Shrivel[z] (1–4) |
|---|---|---|---|---|---|---|---|
| Bag Type | | | | | | | |
| Restricted[b] | 0.22 | 1.5 | 3.0 | 14.5 | 14.2 | 2.3 | 3.4 |
| Commercial[a] | 0.05 | 2.3 | 3.7 | 21.1 | 19.7 | 1.4 | 2.2 |
| P-value | 0.10 | 0.0003 | 0.0001 | 0.0011 | 0.0056 | 0.0001 | 0.0001 |
| $LSD_{0.05}$ | 0.20 | 0.4 | 0.2 | 3.8 | 3.8 | 0.3 | 0.4 |
| Bag Position | | | | | | | |
| Top | 0.09 | 1.9 | 3.3 | 19.1 | 17.8 | 1.8 | 2.8 |
| Bottom | 0.18 | 2.0 | 3.4 | 16.6 | 16.0 | 1.8 | 2.9 |
| P-value | NS | NS | 0.054 | NS | NS | NS | NS |
| $LSD_{0.05}$ | NS | NS | 0.2 | NS | NS | NS | NS |
| Bag Type x Bag Position | | | | | | | |
| Restricted x Top | 0.08 | 1.4 | 3.0 | 16.1 | 16.4 | 2.3 | 3.6 |
| Restricted x Bottom | 0.36 | 1.7 | 3.0 | 12.9 | 11.9 | 2.2 | 3.6 |
| Commercial x Top | 0.10 | 2.3 | 3.5 | 22.0 | 19.1 | 1.3 | 1.9 |
| Commercial x Bottom | 0.00 | 2.3 | 3.9 | 20.2 | 20.2 | 1.5 | 2.4 |
| P-value | NS | NS | 0.054 | NS | NS | NS | 0.081 |

[a]Commercial bag = 30 to 40% perforation
[b]Restricted bag 1.4% perforation
[x]Stern score: 1 = healthy, 2 = slight, 3 = moderate, 4 = severe
[y]Grade: 1 = poor, 2 = fair, 3 = good, 4 = excellent
[z]Shrivel: 1 = severe, 2 = moderate, 3 = slight, 4 = none

TABLE 3

Quality of "Ruby Seedless" table grapes packaged in commercial or restricted cluster bags then stored at 0° C.

| Treatment | Decay (% wt.) | Stem Condition (score 1–4)[x] Browning | Dryness | Phytotoxity (% wt.) | Shatter (% wt.) | Grade[y] (1–4) | Shrivel[z] (1–4) |
|---|---|---|---|---|---|---|---|
| Bag Type | | | | | | | |
| Restricted[b] | 0.36 | 2.6 | 3.0 | 22.0 | 16.7 | 2.4 | 1.3 |
| Commercial[a] | 0.28 | 3.1 | 4.0 | 28.9 | 21.3 | 1.2 | 2.3 |
| P-value | NS | 0.0003 | 0.0001 | 0.0017 | 0.030 | 0.0001 | 0.0001 |
| $LSD_{0.05}$ | NS | 0.3 | 0.2 | 4.2 | 4.2 | 0.3 | 0.3 |
| Bag Position | | | | | | | |
| Top | 0.38 | 2.9 | 3.6 | 27.0 | 22.0 | 1.7 | 1.9 |
| Bottom | 0.27 | 2.8 | 3.3 | 23.9 | 16.0 | 1.8 | 1.8 |
| P-value | NS | NS | 0.0037 | NS | 0.0062 | NS | NS |
| $LSD_{0.05}$ | NS | NS | 0.2 | NS | 4.2 | NS | NS |
| Bag Type x Bag Position | | | | | | | |
| Restricted x Top | 0.47 | 2.7 | 3.3 | 22.6 | 19.4 | 2.2 | 1.5 |
| Restricted x Bottom | 0.25 | 2.5 | 2.7 | 21.4 | 13.9 | 2.6 | 1.2 |
| Commercial x Top | 0.28 | 3.0 | 4.0 | 31.4 | 24.5 | 1.3 | 2.3 |
| Commercial x Bottom | 0.28 | 3.1 | 4.0 | 26.5 | 18.1 | 1.1 | 2.3 |
| P-value | NS | NS | 0.0060 | NS | NS | 0.037 | NS |

[a]Commerciai bag = 30 to 40% perforation
[b]Restricted bag = 1.4% perforation
[x]Stem score: 1 = healthy, 2 = slight, 3 = moderate, 4 = severe
[y]Grade: 1 = poor, 2 = fair, 3 = good, 4 = excellent
[z]Shrivel: 1 = severe, 2 = moderate, 3 = slight, 4 = none

We claim:

1. A grape storage bag, comprising: a top opening, side walls, a bottom and side seams, said bag being made from a plastic film, said bag having a plurality of holes through one or both side walls of the film of the bag each of said holes having a diameter of about ⅛ inch to about ¼ inch, said holes distributed in the bag to provide a percentage perforation ranging from 0.4 to 1.4% wherein the bottom of said bag has a length from about 5½ inches to about 8 inches.

2. The bag of claim 1 further including grapes.

3. The bag of claim 1 wherein the length is about 8 inches.

4. The bag of claim 1 wherein the length is about 5½ inches.

5. The bag of claim 1 wherein said bag has at least a pair of spaced apart apertures positioned about 1½ inches below said top opening.

6. The bag of claim 5 wherein said apertures each have a diameter of about 1½ inches.

7. The bag of claim 6 wherein said pair of apertures are spaced apart about 7 to about 9 inches.

8. The bag of claim 1 wherein said bag has a depth of about 13 to about 14 inches.

9. A grape storage bag adapted to be mounted on a grape packing platform said bag comprising:

a front wall, a rear wall, an open end, and a closed end having a length from about 5½ to about 8 inches said front wall and rear wall having a plurality of holes said holes distributed in the walls to provide a percentage perforation ranging from 0.4 to 1.4% said holes having a diameter of about ⅛ inch to about ¼ inch.

10. The bag of claim 9 wherein said length is about 8 inches.

11. The bag of claim 9 wherein said length is about 5½ inches.

12. The bag of claim 9 wherein said bag has a pair of spaced apart apertures positioned about 1½ inches below said open end.

13. The bag of claim 12 wherein said pair of apertures are spaced apart about 7 to about 9 inches.

14. The bag of claim 12 wherein said pair of apertures are positioned about 1½ inches below said open end.

15. The bag of claim 9 wherein each of said holes has a diameter of ⅛ to ¼ inch.

16. The bag of claim 9 wherein said bag has a depth of about 13 to about 14 inches.

17. A grape storage and shipping container, comprising: two layers of packaged grapes, wherein said grapes are packaged in plastic storage bags, said bags including a top opening, side walls, a bottom and side beams, said bags being made from a plastic film, said bags having a plurality of holes through the film of each bag each of said holes having a diameter of about ⅛ inch to about ¼ inch, said holes distributed in the bag to provide a percentage perforation ranging from 1.0 to 1.4% wherein the bottom of said bag has a length from about 5½ inches to about 8 inches.

18. The container of claim 17 wherein the length is about 8 inches.

19. The container of claim 17 wherein the length is about 5½ inches.

20. The container of claim 17 wherein said bags each have a depth of about 13 to about 14 inches.

21. A grape storage and shipping container, comprising: a single layer of packaged grapes, wherein said grapes are packaged in plastic storage bags wherein said bags include a top opening, side walls, a bottom and side seams, said bags being made from a plastic film, said bags having a plurality of holes through the film of each bag each of said holes having a diameter of about ⅛ inch to about ¼ inch, said holes distributed in the bag to provide a percentage perforation ranging from 0.4 to 1.4% wherein the bottom of said bag has a length from about 5½ inches to about 8 inches.

22. The container of claim 21 wherein the length is about 8 inches.

23. The container of claim 21 wherein the length is about 5½ inches.

24. The container of claim 21 wherein said bags each have a depth of about 13 to about 14 inches.

* * * * *